United States Patent [19]

Harandi et al.

[11] Patent Number: 4,859,308

[45] Date of Patent: Aug. 22, 1989

[54] TWO-STAGE PROCESS FOR CONVERSION OF ALKANES TO GASOLINE

[75] Inventors: Mohsen N. Harandi, Lawrenceville; Hartley Owen, Belle Mead, both of N.J.

[73] Assignee: Mobil Oil Corporation, New York, N.Y.

[21] Appl. No.: 144,991

[22] Filed: Jan. 19, 1988

[51] Int. Cl.[4] ..... C10G 57/00; C10G 63/04

[52] U.S. Cl. ..... 208/49; 208/78; 208/120; 208/160; 208/164; 585/322; 585/324; 585/330; 585/402; 585/407; 585/431; 585/654; 585/659; 585/910

[58] Field of Search ..... 208/113, 120, 78, 79, 208/46, 49, 69, 70, 160, 164; 585/533, 666, 339, 322, 324, 910, 402, 407, 431, 654, 659

[56] References Cited

U.S. PATENT DOCUMENTS

| | | | |
|---|---|---|---|
| 2,397,352 | 3/1946 | Hemminger | 260/683.3 |
| 2,772,217 | 11/1956 | Nicholson | 502/41 |
| 2,784,826 | 3/1957 | Drews et al. | 502/41 |
| 3,392,110 | 7/1968 | Payne | 208/160 |
| 3,894,934 | 7/1975 | Owen et al. | 208/78 |
| 3,907,663 | 9/1975 | Owen | 208/70 |
| 4,152,393 | 5/1979 | Callahan et al. | 422/144 |
| 4,293,722 | 10/1981 | Ward et al. | 585/330 |
| 4,404,090 | 9/1983 | Castillo et al. | 208/521 T |
| 4,422,925 | 12/1983 | William et al. | 208/75 |
| 4,551,229 | 11/1985 | Pecoraro et al. | 208/76 |
| 4,578,366 | 3/1986 | Centinkaya et al. | 502/6 |
| 4,614,726 | 9/1986 | Walters et al. | 502/41 |
| 4,640,763 | 2/1987 | Chou | 208/78 |
| 4,675,461 | 6/1987 | Owen et al. | 585/330 |

*Primary Examiner*—Anthony McFarlane

*Attorney, Agent, or Firm*—Alexander J. McKillop; Charles J. Speciale; L. G. Wise

[57] ABSTRACT

Lower alkanes are converted to olefins in a 'third bed' external catalyst cooler (ECC) in which hot catalyst, from a first regenerator ('second bed') operating in conjunction with a fluid catalytic cracker ('first bed'), thermally cracks and dehydrogenates the alkanes. Because this is an endothermic reaction, the catalyst is autogeneously cooled before it is recirculated to the FCC regenerator. The cracking catalyst is the catalyst of choice in the FCC reactor. Maximum conversion of alkanes to olefins is sought, and can be maintained because the FCC regenerator burns the coke made during alkane dehydrogenation. The olefins produced are then oligomerized in an oligomerization reactor ("fourth" bed) operating in conjunction with a second regenerator ("fifth" bed) to produce a gasoline range stream. The interrelated operation of this combination of five fluid beds is tailored to convert all available low value alkanes, to olefins which are generally in high demand for several uses, particularly to make high value gasoline.

9 Claims, 1 Drawing Sheet

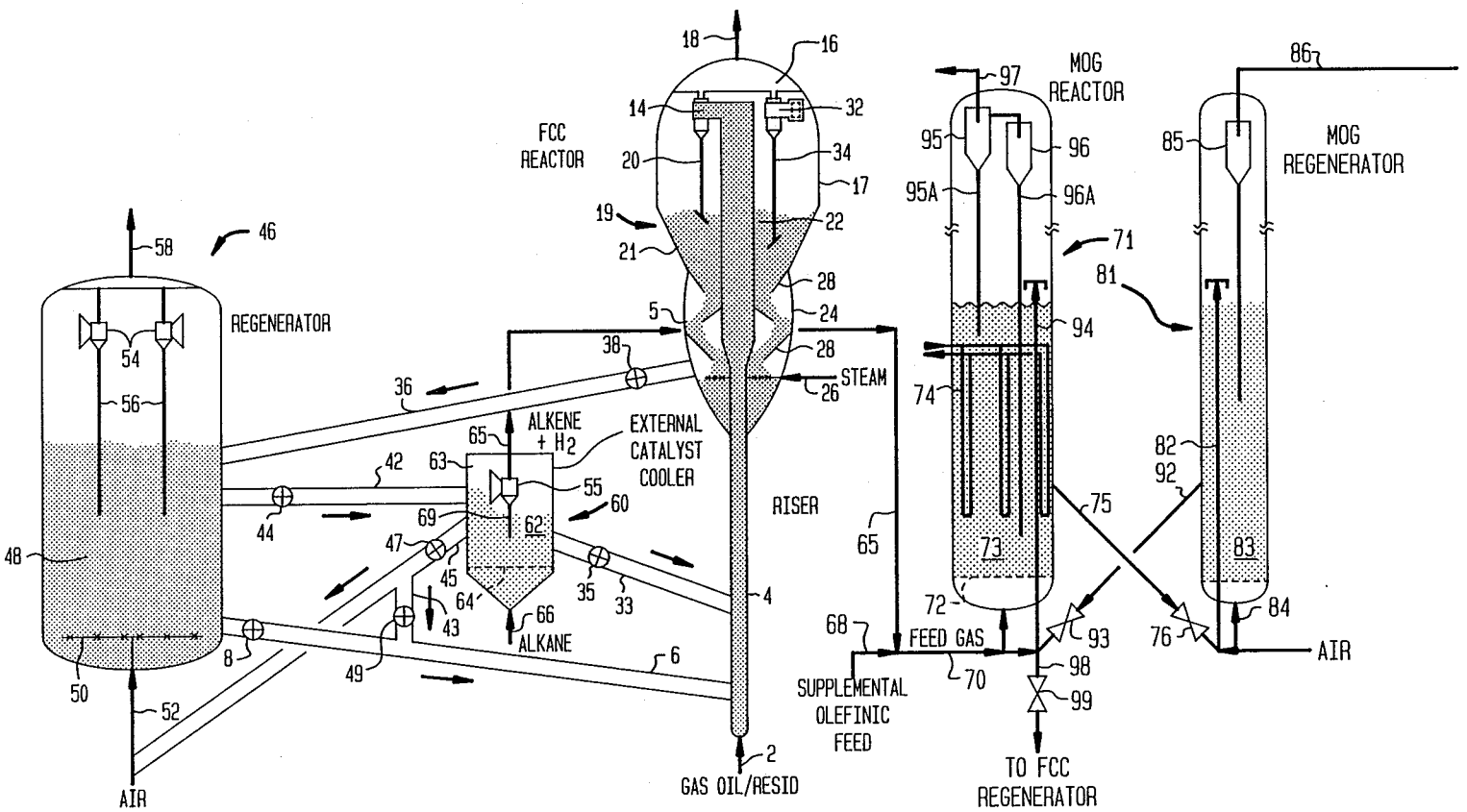
MOG REGENERATOR
MOG REACTOR
FCC REACTOR
REGENERATOR
RISER
STEAM
FEED GAS
SUPPLEMENTAL OLEFINIC FEED
TO FCC REGENERATOR
GAS OIL/RESID
AIR
EXTERNAL CATALYST COOLER
ALKENE + H2
ALKANE

TWO-STAGE PROCESS FOR CONVERSION OF ALKANES TO GASOLINE

BACKGROUND OF THE INVENTION

This invention relates to a process in which we use an external catalyst cooler ("ECC") for dehydrogenating and cracking an alkane stream by contacting it with a fluid catalytic cracking ("FCC") catalyst to produce olefins; the olefins are then oligomerized to gasoline in a single zone of a fluid bed crystalline zeolite oligomerization catalyst, the bed operating in the turbulent regime.

Catalyst from a FCC unit is regenerated in a FCC regenerator operating at high temperature due to the high heat release of burning coke. Hot regenerated catalyst (regent catalyst) is conventionally cooled in a catalyst cooler ("catcooler") by generating steam. The catcooler may be either internal or external. In this invention, we cool the regen catalyst in the ECC which also functions as a dehydrogenation reactor to which the alkanes are fed.

Coupling the dehydrogenation of $C_2$+ alkanes, and particularly a lower $C_2$–$C_6$ alkane, preferably a mixture of propane ($C_3$) and butane ($C_4$) containing a minor amount by weight of olefins and $C_5$+ alkanes, in the ECC, with the operation of a FCC regenerator is described in greater detail in our concurrently filed patent application Ser. No. 144,990 the disclosure of which is incorporated by reference thereto as if fully set forth herein. FCC regenerators are designed to be "hot-operated" under pressure, that is, operated at a pressure in the range from about 25 psig to 40 psig, and as high a temperature as is practical from a materials standpoint. The temperature within a FCC regenerator typically ranges from about 538° C. to about 815° C. (1000°–1500° F.) and the ECC operates in our process, in the same general range of pressure and temperature.

Because the dehydrogenation reaction is partly pyrolytic and partly catalytic (effect of the FCC catalyst), the catalyst is referred to as "dehydrogenation catalyst" or "ECC catalyst" when it is in the ECC, and we refer to the catalyst as "regen catalyst" when it is being regenerated. The thermal dehydrogenation of normally liquid hydrocarbons at a temperature in the range from 538° C. to 750° C. (1000°–1382° F.) by pyrolysis in the presence of steam, is disclosed in U.S. Pat. Nos. 3,835,029 and 4,172,816, inter alia, but there is no suggestion that such a reaction may be used as the basis for direct heat exchange, to cool regen catalyst in an ECC for a FCC unit, and provide a mixture of alkenes (or olefins, mainly mono-olefins) and alkanes (paraffins) in the ECC's effluent, as we have done for the first stage of our two-stage process.

The desirability of upgrading lower alkanes to gasoline, distillate and lubes has long been recognized and U.S. Pat. No. 4,542,247 discloses a process for doing so, requiring two oligomerization zones and separation of the effluent from each, to recover the gasoline values.

The oligomerization of lower olefins, alone or in a mixture with alkanes over a ZSM-5 type catalyst having controlled acidity has been disclosed in U.S. Pat. Nos. 3,960,978 and 4,021,502 to Plank et al., and improvements have been disclosed by Garwood et al in U.S. Pat. Nos. 4,150,062; 4,211,640; and 4,227,992, the disclosures of all of which are incorporated by reference thereto, as if fully set forth herein. The oligomerization to gasoline range hydrocarbons ("gasoline" for brevity) is referred to as the Mobil Olefin to Gasoline, or MOG process, and, in the prior art, is preferably conducted over HZSM-5 at moderately elevated pressure and temperature in the ranges from about 6869 kPa (100 psia) to about 3445 kPa (500 psia), and from about 300° C. to about 500° C., respectively. Our MOG reactor also operates in the same temperature range, but preferably at a pressure lower than 689 kPa (100 psia), for example about 275 kPa (40 psia).

The prior art did not recognize that, particularly for the production of gasoline range hydrocarbons from lower olefins, there would be a great economic advantage if the olefins could be obtained at the proper oligomerization temperature, substantially without cost, and could be oligomerized at relatively lower pressure than previously thought desirable. Since, in the real-life operation of a refinery, lower olefins, and especially $C_4$=+ (butenes, and higher) are valuable for alkylation, etc., it is only particular economic circumstances which justify their use in a MOG unit. The capability of generating these olefins in the ECC without the inefficiencies of conventional indirect regen catalyst cooling provides an unexpected economic impetus to our two-stage process, at the same time providing a source of olefins for other refinery needs.

Further, in this two-stage process, the first stage will also convert light straight run ($C_5$ and $C_6$) alkanes, and $C_5$+ paraffinic raffinate, (such as Udex$^R$ raffinate) to olefins because the conversion of all available $C_3$+ alkanes proceeds with excellent yields at essentially the same process operating conditions of the ECC.

A still further benefit of "tying" the operation of the MOG reactor to the ECC and the FCC unit is that a portion of the spent catalyst from the regenerator for MOG reactor may be withdrawn and introduced into the FCC cracker, instead of being discarded. In this manner, the activity of the MOG catalyst in the MOG reactor may be maintained at the desired optimum, and the otherwise-discarded catalyst functions as an effective catalytic cracking octane enhancer additive.

SUMMARY OF THE INVENTION

It has been discovered that a process to convert alkanes to gasoline may be carried out economically with the operation of at least four, and preferably five reaction zones, the operations of each of which are interrelated. A "first" reaction zone is provided by the fluid bed reactor of a fluid catalytic cracker ("FCC"); a "second" reaction zone is provided by the fluid bed regenerator of the FCC unit; a "third" reaction zone is provided by a dehydrogenation reactor operating as an external catalyst cooler (ECC) to cool FCC catalyst being regenerated in the regenerator; and, a "fourth" reaction zone is provided by an olefin oligomerization ("Mobil Olefin to Gasoline" or "MOG") reactor which converts the olefins to a gasoline range hydrocarbon stream. A "fifth" reaction zone is used in which MOG catalyst is regenerated before it is returned to the MOG reactor.

In particular, it has been discovered that the ECC of a regenerator for a FCC may be fed a predominantly $C_3$ and $C_4$ alkane stream, or a light straight run $C_5$ and $C_6$ stream, or a Udex$^R$ raffinate $C_5$+ stream, or a combination of all streams, and the ECC will produce a "make" of olefins in an effluent which may be combined with an olefinic LPG stream conventionally available from the FCC unit, and optionally, also combined with olefins scavenged from the refinery, so that these olefinic streams may be flowed to a MOG reactor. In the MOG reactor, a portion of the olefins is oligomerized to yield a MOG product rich in gasoline range hydrocarbons.

It is therefore a general object of this invention to feed an alkane stream to an ECC operating in conjunction with the regenerator of an FCC unit to produce a maximum "make" of olefins in the effluent from the ECC at an elevated temperature suitable for oligomerization, and to flow this ECC effluent to a MOG reactor where it is oligomerized to a MOG product stream rich in gasoline range hydrocarbons.

It is a specific object of this invention to enhance the operation of a conventional crude oil refinery having an FCC cracker and regenerator, by providing the refinery with (i) an ECC in which, a large pore FCC catalyst being regenerated, is autogeneously cooled; and, (ii) a cooled MOG reactor containing a medium pore ZSM-5 type catalyst, and equipped with adequate heat exchange means for removing excess heat of reaction and the relatively high heat content of the feed, the MOG reactor cooperating with the ECC, to convert a combined MOG feedstream of a first $C_2$–$C_6$ lower olefin stream ("ECC olefins") from the ECC, and a second $C_2$–$C_6$ lower olefin feedstream ("FCC olefins") from the FCC, to gasoline range hydrocarbons; and, for operational flexibility and economics, to withdraw a portion of the spent MOG catalyst from a MOG regenerator, and use the spent MOG catalyst as FCC catalyst make-up. The MOG regenerator provides a "fifth" reaction zone.

It is also a specific object of this invention to provide a two-stage process, in the first stage of which, a predominantly $C_2$–$C_6$, or predominantly $C_5$–$C_6$ lower alkane stream, is converted to an olefin-containing ECC effluent. In the second stage, the ECC effluent is flowed to the MOG reactor, or, preferably is combined with another lower olefin-containing stream such, as one obtained from an FCC unit, and the combined streams are catalytically converted to gasoline in a fluid-bed MOG reactor. The energy balance around the MOG reactor depends on the "make" of oligomerized product sought by converting the olefin content of the combined ECC effluent and FCC olefin streams. Spent MOG catalyst is regenerated in the MOG regenerator.

BRIEF DESCRIPTION OF THE DRAWING

The foregoing and other objects and advantages of our invention will appear more fully from the following description, made in connection with the accompanying drawing of the preferred embodiment of the invention, wherein:

The FIGURE is a process flow sheet schematically illustrating the operation of a FCC cracker, its regenerator, an ECC, a MOG reactor, and a MOG regenerator for the MOG reactor, which together convert lower alkanes to gasoline.

DETAILED DESCRIPTION OF THE PREFERRED EMBODIMENT

Our unique two-stage process converts alkanes to gasoline by utilizing a combination of at least four reaction zones, each utilizing a solid aluminosilicate catalyst. In this combination, the closely tied operation of the third and fourth reaction zones, in each of which a fluid bed is used to carry out the first and second stages, respectively, of the process, determines the economics of the overall process. In the first stage, a large pore FCC catalyst provides the maximum conversion of alkanes to olefins, and in the second stage, a medium pore MOG zeolite catalyst converts the olefins to gasoline range hydrocarbons in a MOG reactor, the conversion depending upon the "mix" of the feedstream to the MOG.

The effluent from the ECC comprises a mixture of unconverted alkanes and olefins, mainly ethene, propene, and butenes when a $C_4-$ (alkanes having four C atoms and less) is fed to the ECC. A wide range of $C_2+$ alkanes may be fed to the ECC, typically, an available refinery LPG stream is used. The ECC catalyst, cooled by the endothermic dehydrogenation reaction, is returned to the FCC, either to the FCC regenerator, or to a riser of the FCC cracker. Spent MOG catalyst is regenerated in the MOG regenerator, and returned to the MOG reactor; to maintain activity of the MOG catalyst at a preselected high level, a portion of the spent MOG catalyst is periodically, or continuously discharge from the MOG regenerator. Spent MOG catalyst may be introduced either to the FCC regenerator, or to the riser of the FCC cracker, thus mixing it with the large pore catalyst.

In the preferred embodiment of the invention, five reaction zones are continuously operated in combination. The two-stage process comprises, a first stage, including (a) utilizing excess heat from the regeneration zone in a fluid catalytic cracking unit by transporting hot regenerated FCC catalyst from the regeneration zone to an external catalytic cooler,
(b) contacting the hot catalyst in the ECC with lower alkanes at an elevated temperature sufficient to provide conversion of the alkanes to olefins which leave the ECC as an olefinic effluent;
(c) returning catalyst from the ECC directly to the FCC reactor or regenerator at a temperature below the operating temperature of the regenerator; and, a second stage, including (d) feeding the olefinic effluent from the ECC to a MOG reactor for oligomerizing olefins to gasoline range hydrocarbons,
(e) contacting the olefinic feed with a medium pore zeolite catalyst for a time sufficient to oligomerize olefins in the olefinic feed to gasoline range hydrocarbons at superatmospheric pressure and a temperature in the range of from about 315.5° C. to about 538° C. (600°–1000° F.), and,
(f) recovering a gasoline range hydrocarbon stream.

THE FIRST STAGE

Operation of the ECC

The preferred operation of the ECC produces $C_2$–$C_6$ alkenes (mono-olefins) including in the range of from about 30 to 60% by wt of the ECC effluent. Non-deleterious components, such as methane and other paraffins and inert gases, may be present. The preferred feed to the ECC contains more than 30 wt % $C_3$–$C_5$ lower aliphatic hydrocarbons. Under the conditions of reaction severity employed in the ECC, a major proportion by weight of the alkanes, and preferably about 70% by wt are converted.

The preferred cracker catalyst consists essentially of large pore crystalline silicate zeolite, generally in a suitable matrix component. Most preferred is a rare earth promoted FCC catalyst in which additional metal promoters, particularly nickel and vanadium, are laid down by the vacuum gas oil (VGO) or resid feed to the FCC riser, and the metals are oxidized in the regenerator. Though the particular cracker catalyst used is not critical to initiate the dehydrogenation reaction, since part of the reaction is due to thermal cracking, the yield and selectivity to olefins is affected by the catalyst type and its metal content. In addition, the FCC catalyst may contain a small amount of Pt, usually less than 300 ppm, to boost the oxidation of CO to $CO_2$ in the regenerator. Since control of the distribution of products from the FCC is much more important than control of the distribution of products obtained by dehydrogenation, the preferred catalyst for our process is the FCC catalyst of choice.

Conventional non-zeolitic FCC catalysts may be used which are generally amorphous silica-alumina and crystalline silicaalumina. Other non-zeolitic materials said to be useful as FCC catalysts are the crystalline silicoaluminophosphates of U.S. Pat. No. 4,440,871 and the crystalline metal aluminophosphates of U.S. Pat. No. 4,567,029. However, the most widely used FCC catalysts are large pore crystalline silicate zeolites known to possess some catalytic activity with particular respect to converting lower alkanes to alkenes, at a temperature lower than those at which the regenerator of the FCC unit operates. Such zeolites typically possess an average (major) pore dimension of about 7.0 angstroms and above. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few as well as naturally occurring zeolites, such as chabazite, faujasite, modernite, and the like. Also useful are the silicon-substituted zeolites described in U.S. Pat. No. 4,503,023. Zeolite Beta is yet another large pore crystalline silicate which can constitute a component of the mixed catlayst system herein.

Most preferred is a large pore crystalline aluminosilicate zeolite promoted with a catalytic amount of metal or metal oxide of an element selected from Groups V and VIII of the Periodic Table, sufficient to enhance the dehydrogenation activity of the FCC catalyst.

The term "catalyst" as used herein shall be understood to apply not only to a catalytically active material but to one which is composited with a suitable matrix component which may or may not itself be catalytically active. By "cracker or cracking catalyst" we refer to any catalyst used in a fluid cracker which catalyst has some propane-dehydrogenation activity under the pressure and temperature conditions specified for operation of the ECC.

The FCC cracker is operated under fluidized flow conditions, at a temperature in the range from about 1000° F. to about 1350° F., with a catalyst to charge stock ratio of from about 4:1 to about 20:1, and a contact time of from about 1 to about 20 sec. Generally, it is preferred to crack the charge stock in an upflowing riser conversion zone discharging into cyclonic separation means in an upper portion of an enlarged vessel in which the products of cracking are separated from catalyst.

Preferred charge stocks to the cracker comprise petroleum fractions having an initial boiling point of at least 500° F. (260° C.), a 50% point at least 750° F. (399° C.), and an end point of at least 1100° F. (593° C.). Such fractions include gas oils, thermal oils, residual oils, cycle stocks, whole top crudes, tar sand oils, shale oils, synthetic fuels, heavy hydrocarbon fractions derived from the destructive dehydrogenation of coal, tar, pitches, asphalts, hydrotreated feedstocks derived from any of the foregoing, and the like. As will be recognized, the distillation of higher boiling point fractions, above about 750° F. (399° C.) must be carried out under vacuum to avoid thermal cracking. The boiling temperatures utilized herein are expressed, for convenience, in terms of the boiling point corrected to atmospheric pressure.

The separated catalyst is collected in the lower portion of the FCC reactor which is in open communication with the upper end of a downwardly extending stripping zone wherein the catalyst is stripped with countercurrent upwardly flowing stripping gas, such as steam. The stripped products and products of conversion separate from the catalyst and are discharged from the riser conversion zone. They are combined with the cyclonically separated hydrocarbon vapors and passed to one or more downstream zones. The stripped catlayst is transferred to a regenerator for removal of deposited carbonaceous material by burning, thereby heating the catalyst to a temperature in the range from about 1250° F. (676.7° C.) to about 1500° F. (815.5° C.).

The foregoing steps in the operation of a FCC unit are conventional, being recited hereinabove only to point out that the conditions at which the steps are practiced, are dictated by the charge stock and the product mix desired, which in turn dictates the operation of the regenerator.

Referring now to the drawing, there is schematically illustrated a flowsheet in which a charge stock (feed) 2, such as gas oil (boiling range 600°–1200° F., or 315.5°–676.7° C.) is introduced, after it is preheated, into riser 4, near the bottom. The gas oil is mixed with hot regen catalyst, such as zeolite Y, introduced through a valved conduit means such as standpipe 6 provided with a flow control valve 8. Because the temperature of the hot regenerated catalyst is in the range from about 1200° F. (676.7° C.) to about 1350° F. (732.2° C.), a suspension of hydrocarbon vapors is quickly formed, and flows upward through the riser 4.

The riser 4 is flared gently outward into a region 5 through which catalyst and entrained hydrocarbons are flowed, being afforded, in this region 5, the contact time preselected to provide desired cracked products. Catalyst particles and the gasiform products of conversion continue past region 5 and are discharged from the top of the riser into one or more cyclone separators 14 housed in the upper portion 17 of the vessel, indicated generally by reference numeral 19. Riser 4 terminates in a 'bird cage' discharge device, or an open end "T" connection may be fastened to the riser discharge which is not typically directly connected to the cyclonic catalyst separation means. The effluent from riser 4 comprises catalyst particles and hydrocarbon vapors which are led into the cyclonic separators 14 which effect separation of catalyst from hydrocarbon vapors. Such vapors pass into a plenum chamber 16 and thence are removed through conduit 18 for recovery and further processing.

Hydrocarbon vapors from cyclone 14 are discharged to a plenum chamber 16 from which they flow through conduit 18 for further processing and recovery, typically to a fractionator column where the products of cracking are separated into preselected fractions.

Catalyst separated from the vapors descends through dipleg 20 to a fluid bed 22 of catalyst maintained in the lower portion 21 of the vessel 19. The bed 22 lies above, and in open communication with a stripping zone 24 into which the catalyst progresses, generally downward, and countercurrent to upflowing inert gas, usually steam, introduced through conduit 26. Baffles 28 are provided in the stripping zone to improve stripping efficiency.

Spent catalyst, separated from the hydrocarbon vapors in the cyclones, is maintained in the stripping zone 24 for a period of time sufficient to effect a higher temperature desorption of feed-deposited compounds which are then carried overhead by the steam. The stripping zone is maintained at a temperature of about 1250° F. or even higher if hot regenerated catalyst is introduced into the stripping zone by means not shown, as is sometimes done. The steam and desorbed hydrocarbons pass through one or more cyclones 32 which return catalyst fines through dipleg 34 to the bed 22.

Stripped catalyst flows though conduit 36, provided with flow control valve 38, to regenerator 46 containing a dense fluid bed 48 of catalyst into the lower portion of which bed, regeneration gas, typically air, is introduced by distributor 50 supplied by conduit 52. Cyclone separators 54 provided with diplegs 56 separate entrained catalyst particles from flue gas and return the separated catalyst to the fluid bed 48. Flue gases pass from the cyclones into a plenum chamber and are removed therefrom by conduit 58. Hot regenerated catalyst is returned to the bottom of riser 4 by conduit 6, to continue the process with another conversion cycle, all of which is conventionally practiced.

The hot regen catalyst flows though conduit 42, provided with flow control valve 44, to ECC 60 containing a fluid bed 62 of ECC catalyst. As schematically illustrated, the ECC is coupled to the regenerator through the catalyst transfer lines but is physically located externally relative to both the regenerator and the cracker. Into the lower portion of the ECC bed is introduced the ECC feedstream of lower alkanes to be dehydrogenated. Most preferred is a stream in which propane is the major constituent relative to the amount of ethanes and also to the total weight of $C_5+$ hydrocarbon components. The alkane feed is supplied by distributor 64 fed through conduit 66, the ECC feed typically comprising propane, butanes and minor amounts of other lower alkanes, and even smaller amounts of olefins scavenged from various waste refinery streams. The hot stream of regen catalyst withdrawn from the regenerator is quickly cooled by direct contact with the relatively cool gases and catalyst in the ECC bed. The ECC generally operates at relatively low WHSV in the range from 0.01 to 5.0 $hr^{-1}$, preferably from 0.1 to 1.0 $hr^{-1}$, and in a relatively narrow pressure range from above 20 psig to about 50 psig (239–446 kPa), preferably 25 psig to about 45 psig (273–411 kPa), and a temperature from about 1000° to about 1400° F. (538°–760° C.) preferably 1350° F. (732° C.), respectively, depending upon the pressure and temperature at which the FCC regenerator is operated.

The amount of heat supplied to the ECC is determined by a controlled amount of catalyst withdrawn from the regenerator. The rate at which the catalyst stream is withdrawn depends upon the temperature at which the regenerator is to be operated, which in turn determines the amount of alkanes which may be dehydrogenated. For a given flow of regenerated catalyst to the ECC at a preselected temperature, and a given rate of lower alkane charged, the temperature of catalyst in the ECC is controlled in the range from about 1100° to 1350° F. (593°–732° C.) by the temperature to which the charge is preheated.

Cyclone separators 68, provided with a dipleg 69, and more preferably sintered metal filters (not shown), separate entrained catalyst particles from ethylene, propylene, hydrogen, butylenes, other hydrocarbon products and unconverted alkanes, and return the separated catalyst to the fluid bed 62. The more efficient the sintered metal filters, the fewer fines transferred to the MOG reactor. The products of conversion of the dehydrogenation reaction pass from the cyclones into a plenum chamber 63 and are removed therefrom by effluent line 65. Relatively cool ECC catalyst is returned to the regenerator 46 through conduit 45 provided with a valve 47, by being lifted with air in the air-lift conduit 52. If desired, the regenerator may be partly or completely bypassed by flowing the cooled catalyst from the ECC through conduit 33, provided with valve 35, to the riser 4. For greater flexibility of operation, a portion of the cooled catalyst from the ECC is returned to the regenerator through line 45, and the remainder flowed through line 33 to the riser.

Regenerated catalyst is removed from the regenerator through return conduit 6 controlled by valve 8, for passage to the riser 4 of the cracker, either above or below the point where line 33 communicates with the riser. This by-passing of the regenerator by directly flowing cooled catalyst from the ECC to the FCC riser is desirable in cases where maximizing catalyst circulation and minimizing thermal cracking because of the relatively low catalyst temperature in the FCC riser, is desired.

Again, for additional flexibility of operation, cooled catalyst from the line 45 may be flowed through conduit 43, controlled by valve 49, into the return conduit 6.

THE SECOND STAGE

Operation of the MOG Reactor

The olefins which, in the preferred mode of the ECC's operation are predominant in its effluent, may contain up to 45% ethylene, propene, butenes, pentenes, hexenes, and minor amounts of heptenes, octenes, nonenes and their isomers. To this ECC effluent is preferably added a mixture of propene and propane obtained from the FCC column, and the combined streams flowed to the MOG reactor. The partial pressure of the hydrocarbons in the MOG reactor ranges from 2 to 20 atmospheres, preferably from 2 to 5 atm. Almost the entire content of the ECC effluent is desirably upgraded to high octane gasoline containing $C_5{=}+$ aliphatics, preferably $C_8{+}{+}$ olefins, having a RON octane number of from 93–98. In the best mode, at least 10% by weight, and preferably in excess of 40% by wt of the effluent is converted to a high octane gasoline stream.

The MOG reactor is operable with shape selective medium pore catalysts exemplified by ZSM-5, ZSM-11, ZSM-12, ZSM-23, ZSM-35, ZSM-38, ZSM-48 and other similar materials. U.S. Pat. No. 3,702,886 describing and claiming ZSM-5; U.S. Reissue Pat. No. 29,948 describing and claiming a crystalline material with an X-ray diffraction pattern of ZSM-5; and, U.S. Pat. No. 4,061,724 describing a high silica ZSM-5 referred to as "silicalite" are each incorporated by reference thereto as if fully set forth herein. Similarly, the disclosures relating to ZSM-11, ZSM-12, ZSM-23, ZSM-35, ZSM-38, and ZSM-48 set forth in U.S. Pat. Nos. 3,709,979, 3,832,449, 4,076,842, 4,016,245, 4,046,859, and 4,375,573, respectively, are each incorporated by reference thereto as if fully set forth herein.

In general the aluminosilicate zeolites are effectively employed in our second stage MOG reactor. However, zeolites in which some other framework element which is isoelectronic to aluminum and which is present in partial or total substitution of aluminum can be advantageous. For example such catalysts may provide a higher conversion of feed to aromatic components, the latter tending to increase the octane, and therefore the quality of the gasoline produced. Illustrative of elements which can be substituted for art or all of the framework aluminum are boron, gallium, titanium, an,, in general, any trivalent metal which is heavier than aluminum. Specific examples of such catalysts include ZSM-5 and zeolite Beta containing boron, gallium and/or titanium. In lieu of, or in addition to, being incorporated into the zeolite framework, these and other catalaytically active elements can also be deposited upon the zeolite by any suitable procedure, e.g., by impregnation.

Though the MOG reactor is operable with any of the aluminosilicates, the preferred catalyst is a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, B or Fe, within the zeolitic framework. These medium pore zeolites are favored for acid catalysis; however, the advantages of ZSM-5 type structures may be utilized by employing highly siliceous materials or crystalline metallosilicates having one or more tetrahedral species having varying degrees of acidity. The ZSM-5 crystalline structure is readily recognized by its X-ray diffraction pattern, which is described in U.S. Pat. No. 3,702,886 (Argauer, et al.), incorporated by reference herein.

The oligomerization catalysts preferred for use herein include the medium pore (i.e., about 5–7A) shape-selective crystalline aluminosilicate zeolites having a silica-to-alumina ratio of at least 12, a constraint index of about 1 to 12 and acid cracking activity of about 10–250. In the fluidized bed reactor the coked catalyst may have an apparent activity (alpha value) of about 10 to 80 under the process conditions to achieve the required degree of reaction severity. Representative of the ZSM-5 type zeolites are ZSM-5, ZSM-11, ZSM-12, ZSM-22, ZSM-23, ZSM-35 and ZSM-38. Details about ZSM-5 are disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,046,839; 4,414,423; 4,417,086; 4,517,396 and 4,542,251, the disclosures of which are incorporated by reference thereto as if fully set forth herein. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt.% silica and/or alumina binder.

These siliceous zeolites may be employed in their acid forms, ion exchanged, or impregnated with one or more suitable metals, such as Ga, Pd, Zn, Ni, Co and/or other metals of Periodic Groups III to VIII. The zeolite may include a hydrogenation dehydrogenation component (sometimes referred to as a hydrogenation component) which is generally one or more metals of group IB, IIB, IIIB, VA, VIA or VIIIA of the Periodic Table (IUPAC), especially aromatization metals, such as Ga, Pd, etc. Useful hydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc. The catalyst materials may include two or more catalytic components, such as a metallic oligomerization component (eg, ionic $Ni^{+2}$, and a shape-selective medium pore acidic oligomerization catalyst, such as ZSM-5 zeolite) which components may be present in admixture or combined in a unitary bifunctional solid particle.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5, suitably modified, having a silica : alumina molar ratio of 25:1 to 70:1 with an apparent alpha value of 10–80 to convert a major portion, preferably at least 60% by weight of the olefins in the feedstock.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %. In the description of preferred embodiments a 25% HZSM-5 catalyst contained within a silica-alumina matrix and having a fresh alpha value of about 80 is employed unless otherwise stated.

The average particle density of the catalyst used may be tailored for optimum fluid-bed operation by compositing it with a matrix component of appropriate density. Such matrix components which provide particles of progressively increasing overall packed density are silica, alumina, beryllia, magnesia, barium oxide, zirconia, and titania, yielding values of from about 2.2 $gm/cm^3$ for silica, up to about 5.9 $gm/cm^3$ for zirconia. In the MOG reactor, the overall packed density of medium pore zeolite particles so composited, including the matrix component, can advantageously vary from about 0.6 to about 4 $gm/cm^3$, more preferably from about 2 to about 3 $gm/cm^3$, in the MOG reactor.

The reaction severity conditions in the ECC are controlled to maximize yield of $C_2$–$C_6$ olefins, and those in the MOG reactor are controlled to maximize gasoline. Accordingly, though only the process conditions can be varied in the ECC because the catalyst in it is the FCC catalyst of choice, an important criterion for an economical process is to select and maintain a catalyst inventory in the MOG reactor to provide either fresh catalyst having the desired alpha (activity), or by controlling catalyst deactivation and regeneration rates of the MOG catalyst so as to provide an apparent average alpha value of about 2 to 50, preferably in the range from 2 to 10.

Reaction temperatures and contact time affect reaction severity. Process conditions in the MOG reactor are chosen to provide substantially steady state conditions wherein the reaction severity index (R.I.) is maintained to yield a desired weight ratio of olefins to alkanes and in particular butane to butenes. Though it appears this index may vary from about 0.01 to 200 in the presence of added propane, it is preferred to operate the steady state fluidized bed unit to hold the R.I. at about 0.02:1 to 5:1. While reaction severity is advantageously expressed as the weight ratio of propane:propene in the gaseous phase, it may also be approximated by the analogous ratios of butanes:butenes, pentanes:pentenes, or the average of total reactor effluent alkanes:alkenes in the $C_3$–$C_5$ range. The higher the R.I. value, the higher the conversion for $C_3$, $C_4$ and $C_5$ aliphatics and the overall alkanes:alkenes ratio. These values are in the range from about 0.1 to 20 with a typical $C_3$–$C_5$ olefinic feedstock. The optimum value will depend upon the exact catalyst composition, feedstock and reaction conditions; however, the typical propene-containing light gas mixtures used in the examples herein and similar cracking process off-gas can be optionally upgraded to the desired aliphatics-rich gasoline by keeping the R.I. at about 1.

In a typical reaction system, the fourth reaction zone MOG reactor operating at a temperature in the range from about 315.5° C. to about 538° C. (600°–1000° F.), is provided with a temperature-controlled dense zone of catalyst fluidized around plural heat exchanger coils through which a heat exchange (cooling) fluid is circulated. The coils are preferably spaced apart in a preselected geometry to provide axial and radial mixing, to enhance the back mixing, and to serve as baffles for lowering the effective hydraulic diameter of the reactor. In addition, there may be provided an adjustable gas quench so that one or the other heat exchange means may be used to control the temperature of the bed in the operating range of 600°–950° F. Hot cooling fluid leaving the reactor may be used to preheat feedstock and/or a liquid recycle stream of product in which a major portion of the heavies has been stripped by prefractionation. In addition to the heat exchange means referred to hereinabove, the temperature in the reaction may be controlled by feeding cold feed.

The weight hourly space velocity (WHSV) in the MOG reactor, based on total olefins in the fresh feed stock is in the range from about 0.1 to 20 $hr^{-1}$, preferably in the range from 0.2 to 1 $hr^{-1}$.

Spent catalyst to be regenerated is preferably first stripped in a stripper (not shown) with an inert gas, typically steam or nitrogen before being regenerated in the usual way with air under high pressure to fluidize the catalyst. A particular operating economy may be realized with operation of the MOG regenerator and the FCC regenerator at about the same pressure, because the same compressor can be used to provide regen air to each. In the particular case where the MOG reactor operates at a substantially higher pressure, the flow of air from the compressor to the MOG regenerator may be boosted with a smaller booster compressor. Fines from the effluent of the regenerator are collected in high temperature filters and/or cyclones. To work out details of operation of the reaction system under the pressure and temperature conditions specified is well within the skill of the art and does not require any further description. Catalyst makeup is added from a high pressure catalyst makeup hopper so as to maintain the desired level in the reactor.

Referring further to the drawing for additional details of a typical five-reaction zone system, the effluent 65 from the ECC (third reaction zone) is flowed through feed line 70 to the MOG reactor 71 (the fourth reaction zone) so that the main flow is directed through grid plate 72 into the fluidization zone 73 where the feed gas contacts the turbulent bed of finely divided catalyst particles. The reactor 71 is provided with heat exchange tubes 74 which may be arranged in any suitable configuration to provide baffling for the optimum radial and axial flow of catalyst around the baffles, and temperature control of the catalyst bed. Additional baffles and open-ended downcomer tubes may also be provided as "reactor internals" to control the hydraulics of catalyst flow as disclosed for example in U.S. Pat. No. 4,251,484 to Daviduk et al. The bottoms of the heat exchanger tubes 74 are spaced above the distributor grid 72 sufficiently to be free of jet action by the charged feed through the small diameter holes in the grid. Additionally, the temperature of the bed may be controlled by introducing a cold feed.

Catalyst draw-off pipe 75 is provided for withdrawing catalyst from the bed 73 and flowing it through valve 76 to MOG regenerator 81 (the fifth reaction zone) operating at a pressure lower than that in said oligomerization reactor, and a temperature in the range from about 371° C. to about 538° C. (700°–1000° F.). Partially deactivated MOG catalyst is oxidatively regenerated by controlled contact with air or other regeneration gas at elevated temperature in the MOG regenerator 81 to remove carbonaceous deposits leaving less than 3% coke, and to restore desired catalyst activity. It is preferred to use a small amount of platinum in the catalyst to obtain better burning of coke during regeneration. Desired acid activity (alpha value at equilibrium) is in the range from 2 to 20 with a fines content (40 microns or less) of about 25%.

After regeneration, the catalyst particles are entrained in a lift gas and transported via riser tube 82 to an upper portion of the regenerator 81. Air is distributed at the bottom of the bed 83 through line 84, and the oxidation products are carried out of the regeneration zone through cyclone separators 85 which return solids entrained with the oxidation products. The oxidation products (flue gas) are led away from the regenerator 81 through line 86, and disposed of.

Regenerated MOG catalyst is returned to the MOG reactor 71 through draw-off line 92 provided with flow control valve 93. The regenerated catalyst is lifted into the catalyst bed 73 with pressurized feed gas through catalyst return riser 94. Since the amount of regenerated catalyst returned to the reactor is relatively small, the temperature of the regen catalyst does not upset the temperature constraints of the MOG reactor appreciably. A series of sequentially connected cyclone separators 95, 96 in the upper portion of the reactor 71 are provided with diplegs 95A, 96A to return entrained catalyst fines to the lower portion of bed 73. Filters, such as sintered metal plate filters (not shown), may be used alone or in conjunction with the cyclones, for more efficient separation.

The effluent from the MOG reactor (MOG effluent) leaves through line 97 at elevated pressure in the range from about 100 to about 275 kPa (15 to 40 psia). The MOG effluent is flowed to a "heavies" recovery section and particularly to a prefractionator (not shown) from which olefin-rich overhead is recovered. If desired, a portion may be recycled to the MOG reactor for heat exchange, and addition as a gas, under high pressure.

The regenerator preferably operates at about the same pressure as the reactor. To maintain the activity of the catalyst in the MOG reactor, a portion of the regenerated medium pore MOG catalyst may be withdrawn through line 98 and flowed through control valve 99 to the FCC regenerator 46. If desired it may be flowed to the riser of the FCC reactor, or to the ECC (flow connections not shown). A mixed catalyst system in which a catalyst requiring frequent regeneration, such as zeolite Y, may be employed in combination with a shape selective medium pore crystalline silicate zeolite catalyst requiring comparatively infrequent regeneration such as ZSM-5, as disclosed in copending U.S. patent applications Ser. Nos. 903,311 filed Sept. 3, 1986 by Owen et al, and 060,541 by Avidan et al, filed Nov. 6, 1987, the disclosures of which are incorporated by reference thereto as if fully set forth herein. The preferred "makeup" for catalyst, that is % inventory per day, is in the range from 0.5 to about 1%.

Under optimized process conditions the superficial vapor velocity in the turbulent bed is in the range from about 0.5 to 2 m/sec. At higher velocities entrainment of fine particles may become excessive and beyond about 3 m/sec the entire bed may be transported out of the reaction zone. At lower velocities, the formation of large bubbles or gas voids can detrimentally affect conversion.

A convenient measure of turbulent fluidization is the bed density. A typical turbulent bed has an operating density of about 100 to 700 kg/m$^3$, preferably from 200 to 500 kg/m$^3$, measured at the bottom of the reaction zone, becoming less dense near the top, due to pressure drop and article size differentiation. Pressure differential between two vertically spaced points in the reactor column can be measured to obtain the average bed density in the designated portion of the reaction zone. For example, in a fluidized bed MOG reactor employing ZSM-5 particles having an average density of 2430 kg/m$^3$, an average fluidized bed density of about 300 to 500 kg/m$^3$ is satisfactory.

In the turbulent regime in which the MOG bed operates, the WHSV (based on total catalyst weight) in the range from about 0.1 to 1.0, provides a close control of contact time between vapor and solid phases, typically in the range from 3 to 30 secs; further, the turbulent regime controls bubble size and life span, thus avoiding large scale by-passing of gas in the reactor. The turbulent regime extends from the transition velocity to the so-called transport velocity, as described in U.S. Pat. No. 4,547,616 to Avidan et al. As the transport velocity is approached, there is a sharp increase in the rate of particle carryover, and in the absence of solid recycle, the bed could empty quickly.

When employing a ZSM-5 type zeolite catalyst in fine powder form, the zeolite catalyst is suitably bound to, or impregnated on a suitable support with a solid density (weight of a representative individual particle divided by its apparent "outside" volume) in the range from 0.6 to 2 g/cc, preferably 0.9 to 1.6 g/cc. The catalyst particles can be in a wide range of sizes up to about 250 microns, with an average particle size between 20 and 100 microns, preferably in the range from 10 to 150 microns, and with the average particle size between 40 and 80 microns. The optimum particle size distribution is obtained with a mixture of larger and smaller particles within the afford specified range, having from 10–20% by weight fines. Close control of distribution is maintained with the fines in the size range less than 32 microns. When these catalyst particles are fluidized in a bed where the superficial fluid velocity is 0.2 to 2 m/sec, operation in the turbulent regime is obtained. The average catalyst residence time is preferably in the range from 0.5 to 2 hr, most preferably less than 1 hr. The MOG rector may assume any technically desirable configuration but is at least about 3 and may be as much as 20 meters high, preferably about 8 to 12 meters.

EXAMPLE

6500 BPSD of a lower alkane stream containing propane and n-butane is flowed to the ECC in which a rare earth impregnated type Y large pore cracking catalyst is being cooled by dehydrogenating the stream. The operating pressure of the ECC is about 30 psig (308 kPa) and the bed temperature about 1200° F. (649° C.). We obtain approximately 40% conversion to olefins, the major portion of the propane and butanes being converted. The effluent leaves the ECC at a temperature of about 1200° F.

The effluent from the ECC is combined with 3500 BPSD of a FCC PP stream (75% olefinic), and the combined streams flowed to an MOG reactor with a bed height of about 8 m, operating at a temperature of about 371° C. (700° F.) and pressure of about 240 kPa (20 psig) with a superficial velocity of about 0.4 m/sec.

The catalyst used is a ZSM-5 type catalyst having a fresh alpha value of about 100 and the MOG reactor produces approximately 2800 bbl/day of $C_5$+ gasoline stream with a 92 research octane number (RON), containing predominantly $C_5$–$C_{10}$ hydrocarbons.

Spent MOG catalyst is regenerated in the MOG regenerator operating at a temperature of about 850° F. (454° C.) and a pressure of about 20 psig (240 kPa). The "coke make" on the catalyst is unexpectedly low and the carbon content of the regenerated MOG catalyst is easily maintained at a level below 1% by weight. Contaminants in the olefin effluent from the ECC to the MOG reactor are kept to a minimum because of the adsorption capability of the ECC catalyst for the usual contaminant. The adsorbed contaminants are then readily and conveniently disposed of in the regenerator along with any coke generated in the ECC.

Having thus provided a general discussion, described the dehydrogenation/cracking of an alkane feedstream in the ECC to produce an olefinic effluent which is then oligomerized to a hydrocarbon stream in the gasoline range, and set forth a specific illustration of the present invention in ana example in support thereof, it is to be understood that no undue restrictions are to be imposed by reason thereof except as provided by the following claims.

We claim:

1. In a two-stage process for upgrading hydrocarbons in at least four reaction zones cooperating to produce gasoline range hydrocarbons from lower alkanes, said reaction zones comprising first reaction zone to crack gas oil range hydrocarbons utilizing a large pore cracking catalyst, a second reaction zone in which said large pore catalyst is oxidatively regenerated, a third reaction zone in which an external catalyst cooler autogeneously cools regenerated catalyst by dehydrogenation of said lower alkane stream to produce an olefinic effluent, and, a fourth reaction zone in which said olefinic effluent is oligomerized to said gasoline range hydrocarbons, the improvement comprising, a first stage, comprising (a) utilizing excess heat from said second reaction zone by transporting hot regenerated fluid catalytic cracking catalyst from said second reaction zone to said third reaction zone located externally relative to said second zone;

(b) contacting said hot fluid catalytic cracking catalyst, at substantially the same temperature as that in said second reaction zone, with $C_3+$ alkanes in said third reaction zone at a pressure in the range from about 239 to 411 kPa (20 to 50 psig) and a temperature below that of said second reaction zone, at a weight hourly space velocity WHSV in the range from 0.01 to 5.0 $hr^{-1}$ to provide conversion of the alkanes to olefins which leave said third reaction zone as said olefinic effluent separated from catalyst;

(c) returning a specified amount of separated fluid catalytic cracking catalyst from said third reaction zone directly to said first or second reaction zone at a temperature below the operating temperature of said first or second reaction zone; and, a second state, comprising (d) passing said olefinic effluent from said third reaction zone to a fourth reaction zone for oligomerizing olefins to gasoline range hydrocarbons, (e) contacting said olefinic effluent with a medium pore zeolite catalyst effective to oligomerize the olefins to gasoline range hydrocarbons at superatmospheric pressure less than about 446 kPa (50 psig) and a temperature in the range of from about 315.5° C. to about 538° C. (600°-1000° F.), at a WHSV in the range from 0.01 to 20.0 $hr^{-1}$; and, (f) recovering a gasoline range hydrocarbon stream from the effluent of said fourth reaction zone.

2. The process of claim 1 wherein said lower alkanes are selected from a stream consisting essentially of propane butanes pentanes, hexanes, heptanes and a mixture of two or more of the foregoing.

3. The process of claim 1 wherein said third reaction zone is provided by an external catalyst cooler operating at a temperature in the range from about 538° C. to about 740° C. (1000-1400° F.).

4. The process of claim 1 further comprising a fifth reaction zone wherein spent catalyst from said fourth reaction zone is oxidatively regenerated, said process further comprising, contacting said spent catalyst from said fourth zone, in said fifth reaction zone, at a temperature in the range from about 371° C. to about 538° C. (700-1000° F.) for a time sufficient to oxidize carbonaceous deposits on the catalyst, and, returning a specified amount of catalyst from said fourth reaction zone having a carbon content in the range from 0 to 1% by weight, from said fifth reaction zone to said fourth reaction zone at a temperature below the operating temperature of said fourth reaction zone.

5. A two-stage process for converting $C_2+$ alkanes to olefins which are in turn converted to gasoline range hydrocarbons, comprising, (a) passing an alkane feedstream into a dehydrogenation zone consisting essentially of a large pore zeolite catalytic cracking catalyst at superatmospheric pressure less than about 446 kPa (50 psig) and a temperature in the range from about 538° C. to about 760° C. (1000°-1400° F.) at a weight hourly space velocity WHSV in the range from 0.01 to 5.0 $hr^{-1}$ to convert at least 20% by weight of the alkanes to alkenes which leave said dehydrogenation zone as an olefinic effluent separated from catalyst;

(b) returning a specified amount of separated fluid catalytic cracking catalyst from said dehydrogenation zone directly to a fluid catalytic cracking zone or to a regeneration zone in which said large pore catalyst is oxidatively regenerated, said large pore catalyst being returned from said dehydrogenation zone at a temperature below the operating temperature of said fluid catalytic cracking zone or said regeneration zone;

(c) contacting said olefinic effluent in an oligomerization zone comprising a single turbulent fluid bed regime of medium pore zeolite catalyst effective to oligomerize the olefins to gasoline range hydrocarbons at superatmospheric pressure less than about 446 kPa (50 psig), and a temperature in the range of from about 315.5° C. to about 538° C. (600°-1000° F.), at a WHSV in the range from 0.01 to 20.0 $hr^{-1}$; and, (d) recovering a gasoline range hydrocarbon stream from the effluent of said oligomerization zone.

6. The process of claim 5 wherein said large pore catalyst is passed through said dehydrogenation zone from said regeneration zone and is returned to said regeneration zone; and, said medium pore catalyst is passed through a regeneration zone in which said medium pore catalyst is oxidatively regenerated, said medium pore catalyst being returned to said oligomerization zone after it is regenerated; whereby contaminants affecting oligomerization are kept to a minimum thus extending the active life of said medium pore catalyst.

7. The process of claim 6 wherein said regenerated large pore catalyst is returned to the fluid catalytic cracking zone.

8. The process of claim 7 wherein said alkanes stream consists essentially of $C_2$-$C_6$ alkanes; and said gasoline stream consists essentially of $C_5$-$C_{10}$ hydrocarbons.

9. The process of claim 8 wherein a specified amount of spent medium pore catalyst is withdrawn from said second regeneration zone and introduced into said first regeneration zone.

* * * * *